United States Patent [19]

Warner

[11] 3,978,533

[45] Sept. 7, 1976

[54] DEVICE FOR RETAINING FACE WARMTH

[76] Inventor: Henry B. Warner, 1956 Gillilan St., Placentia, Calif. 92670

[22] Filed: Apr. 29, 1974

[21] Appl. No.: 464,883

[52] U.S. Cl. ..... 5/327 R

[51] Int. Cl.[2] ..... A47G 9/00

[58] Field of Search ..... 5/344, 327, 337; 297/184; 128/399, 402, 132; 229/22, 3.5 MF

[56] References Cited

UNITED STATES PATENTS

| | | | |
|---|---|---|---|
| 778,688 | 12/1904 | Marsh | 135/5 E |
| 2,781,767 | 2/1957 | Blankenship, Jr. | 135/7.1 R |

FOREIGN PATENTS OR APPLICATIONS

| | | | |
|---|---|---|---|
| 774,580 | 9/1934 | France | 135/5 R |

*Primary Examiner*—Werner H. Schroeder
*Assistant Examiner*—Doris L. Troutman
*Attorney, Agent, or Firm*—Nilsson, Robbins, Dalgarn & Berliner

[57] ABSTRACT

A device for retaining face warmth, formed of an integral, one-piece, generally planar blank of rigid material having a metallized surface on at least one planar side. The blank is cut and scored to provide walls which fold toward the metallized surface to form a self-supporting enclosure for a human head. A rear wall is provided which includes a horizontally central extent approximating the perimeter dimension of a human head and which is tapered from its bottom edge to at least a region above said central extent.

10 Claims, 6 Drawing Figures

DEVICE FOR RETAINING FACE WARMTH

FIELD OF THE INVENTION

The field of art to which the invention pertains includes the field of enclosures, particularly such structures as can be set up from flat, unassembled blank form.

BACKGROUND AND SUMMARY OF THE INVENTION

When sleeping in the open air, as when camping, sleeping bags or the like are often used to provide warmth and comfort for the body. However, such devices generally leave all or a portion of the head exposed to cold, drying air. Completely enclosing the head in the sleeping bag reduces fresh air circulation. Prior devices to alleviate this problem have required the use of frames and canvases to construct a head covering, usually integral with a sleeping bag. Such devices provide only limited protection, but significantly add to the bulk and weight of the camper's equipment.

The present invention provides an enclosure for retaining face warmth which is effective, inexpensive, light in weight and easily stored and carried. Several embodiments are provided, each of which utilize an integral, one-piece, generally planar blank of rigid material, such as corrugated paper having a metallized surface on at least one planar side. The blank is cut and scored to provide a plurality of walls which fold toward the metallized surface to form a self-supporting enclosure for a human head. In each embodiment, a rear wall is provided which includes a horizontally central extent approximating the perimeter dimension of a human head and which is tapered from its bottom edge to at least a region above said central extent. The rear wall is hingedly connected along a score line to at least one of the other walls, and further connection is accomplished by interlocking tabs and slots.

In one embodiment, side walls extend from score lines on both sides of a top wall which is connected by the first-mentioned scored line hinge to the rear wall. Tab and slot combinations connect the side walls to the sides of the rear wall to provide a structure which is open at its front and bottom and which is trapezoidal in vertical cross-section.

In another embodiment, two side walls are connected together at their top edges, and to the rear wall along their rear edges, to form a gabled structure which is open at its front and bottom and which is triangular in vertical cross-section.

In another embodiment, the rear wall is formed with a curvilinear taper, a bottom wall is provided, connected by a scored line hinge to the bottom edge of the rear wall, and the opposite ends of a curved roof are connected to the opposite respective sides of the bottom wall. A central, rear edge portion of the roof is connected to the top edge portion of the rear wall to form a structure which is open at its front end and which is semi-circular in vertical cross-section.

Known prior art includes U.S. Pat. Nos. 36,685, 445,049, 615,642, 929,357, 1,257,984, 1,267,551, 2,543,597, 2,555,051, 2,830,305, 2,853,088, 3,045,261 and 3,241,160, Austrian Pat. No. 143,163 and British Pat. Nos. 3,255/1881 and 2,665/1908.

DETAILED DESCRIPTION

Figure 1:
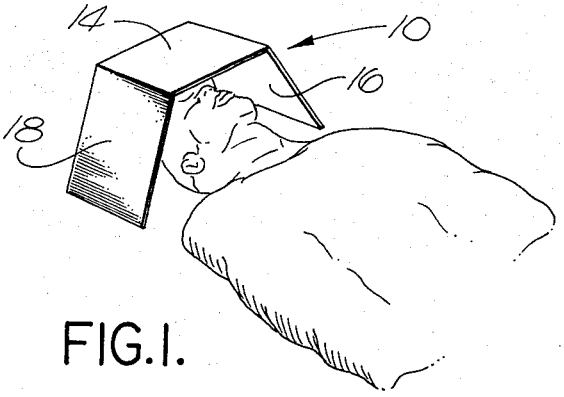
FIGS. 1 and 2 are front perspective views of a first embodiment, FIG. 1 showing the use thereof.
Figure 2:
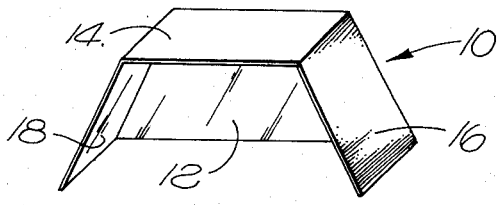

Referring to FIGS. 1 and 2, in a first embodiment, an enclosure 10 is provided which is open at its front and bottom and which is defined by a rear wall 12, top wall 14 and side walls 16 and 18. The walls are arranged so that the enclosure is trapezoidal in vertical cross-section. The inner surfaces of the enclosure are metallized, i.e., formed with material having a metallic surface which serves to reflect heat radiation. A person lying in a sleeping bag or the like, can lie with his head within the enclosure 10. Heat radiating from his face is reflected back from the metallized inner surface of the enclosure 10 keeping the user's head warm yet permitting open access to fresh air. Furthermore, due to breath moisture condensation, and breath retention, the humidity of the air in each breath is relatively high so that drying of the nose, throat and lungs, and cooling of the lungs are avoided.

The rear wall 12 is formed with a trapezoidal shape so that it has a rectilinear taper from its bottom edge to its top edge. Such construction permits a plurality of enclosures 10 to be nested into a compact stack for daytime storage in one corner of a tent or other convenient area.

Figure 3:
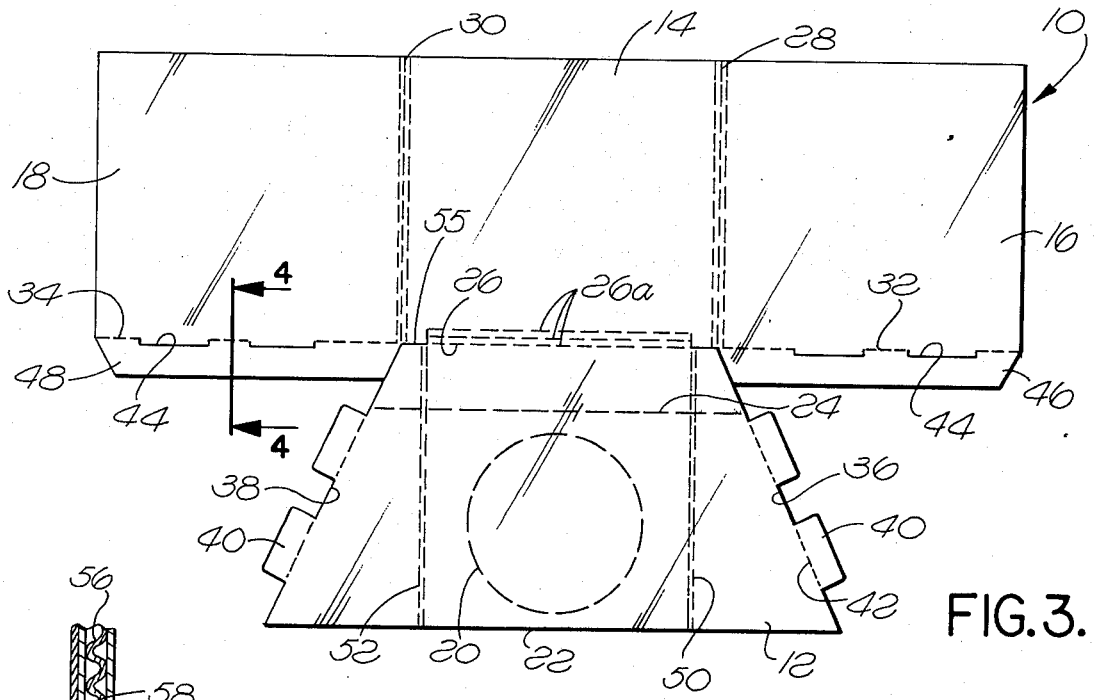
FIG. 3 is a plan view of a blank for forming the first embodiment.

Referring to FIG. 3, the enclosure 10 is formed of an integral, one-piece, generally planar blank of rigid material, having at least the inner surface when assembled, metallized, as above-mentioned. In the embodiment illustrated, and in each of the embodiments hereinafter, the rear wall 12 is dimensioned so that it has a horizontally central extent indicated by the dashed lines 20, approximating the perimeter dimensions of a human head. The width dimension of the rear wall is substantially larger than the central extent and tapers from its bottom edge 22 to at least a region, shown by the dashed line 24, above the central extent. In the trapezoidal enclosure 10 of FIGS. 1–3, the rear wall extends somewhat further than the region 24, terminating at a score line 26 defining its upper edge.

The blank defines the top wall 14 by means of the score line 26 and a plurality of additional score lines 26A thereat, and further defines the side walls 16 and 18 by opposing sets 28 and 30 of parallel plural score lines. The latter score lines 28 and 30 are normal to the score lines 26 and 26A between the top wall and rear wall 12. Sets of plural score lines are provided to accommodate the thickness dimension of corrugated board.

The top wall 14 and side walls 16 and 18 are rectangular in shape. The rear (when assembled) side wall edges 32 and 34, respectively, are dimensioned so as to be coterminate with the side edges 36 and 38 of the rear wall 12. The side edges 36 and 38 of the rear wall have tab extensions 40 thereon hingedly connected by score lines 42 in a line with the side edges 36 and 38.

The tabs 40 engage and lock with slots 44 defined at the juncture of flaps 46 and 48 extending respectively from the bottom edges 32 and 34 of the side walls 16 and 18 at score lines thereat.

Additionally, the rear wall 12 has score lines 52 and 54 extending from its bottom edge 22 to its top edge-defining score line 26, on opposite sides of the aforementioned central extent 20 whereby to provide flexure of the rear wall during assembly of the enclosure 10. To further facilitate folding, return cuts 55 are provided through the board inwardly from the juncture of the rear wall and top wall corners.

In assembly, the walls are folded toward the metallized surface, the sets of plural fold lines permitting flexibility in adjusting the walls respective of each other. The tabs 40 are inserted into the slots 44 and reversely bent so that the blank forms a self-supporting rigid structure.

The structure of FIGS. 1–3 is dimensioned so that the bottom edge 22 is about 15–36 inches wide, the top edge 26 is about 8–15 inches wide and the region 24 is about 10–24 inches wide. In a specific embodiment, the bottom edge is 25 inches wide and the top edge is about 13 inches wide.

As above described, the blank is formed of a rigid material which can be coated on at least one side with a metallic finish. Any appropriate material can be used such as paper, cardboard, rigid plastics, including stiff unfoamed plastic as well as foamed plastic, such as polyvinylchloride, foamed polystyrene, corrugated board, or other material, preferably a material which, like foam or corrugated board, has an open structure providing heat insulative properties.

Figure 4:
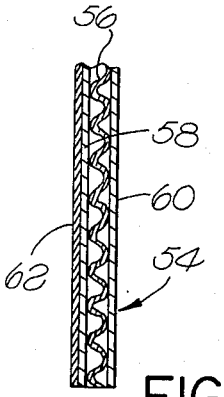
FIG. 4 is a fragmentary cross-sectional view taken on line 4—4 in FIG. 3.

Referring to FIG. 4, the preferred structure is formed of corrugated board 54 wherein a sheet of corrugated paper 56 is sandwiched between two paper sheets 58 and 60. Such material, while providing for a rigid structure, nevertheless enables the structure, even when fully formed, to be crushible, so that if a child, for example, should trip and fall on the structure, it should not injure him.

One of the surfaces of the corrugated board, facing inwardly when assembled, is defined by aluminum foil 62 which is secured to the corrugated board by adhesive or the like. Alternatively, the board surface can be plated with aluminum or with any other reflecting metal such as chromium, nickel, tin, zinc, etc. Methods for electrolessly plating paper to provide such surfaces are well known in the art.

Figure 5:
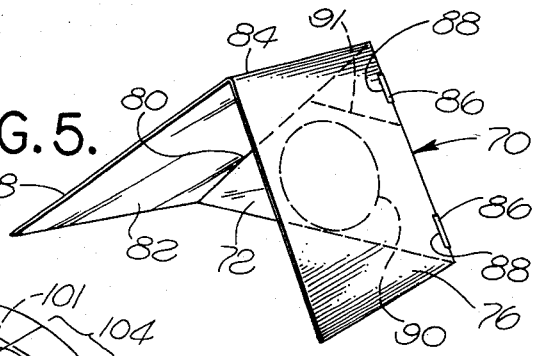
FIG. 5 is a front perspective view of a second embodiment with edges continued by dashed lines.

Referring to FIG. 5, a second embodiment is illustrated wherein an enclosure 70 is defined by a rear wall 72 having a triangular shape and rectangular side walls 78. In the embodiment illustrated, one of the side walls 78 is hingedly connected to the rear wall 72 via a score line 80, (which can be defined by a plurality of score lines, to provide flexure for corrugated board, as above).

The side walls 76 and 78 are hingedly connected together at their top edges via the score line 84. One of the side wals 76 is connected at its edge to the abutting edge of the rear wall 72 by means of tabs 86 extending from the tapered side edge of the rear wall 72 and locking into slots 88 correspondingly formed along adjacent edge portions of the side wall 76. The rear wall 72 is sufficiently wide at its base to provide a central extent, indicated by the dashed lines 90, approximating the perimeter dimension of a human head. It will be seen that the rear wall tapers rectilinearly from its bottom edge beyond a region 91 above the central extent 90. The enclosure 70 can be used in the same manner as the enclosure 10 illustrated in FIGS. 1–3, and a plurality of enclosures 70 can be nested for storage.

Figure 6:
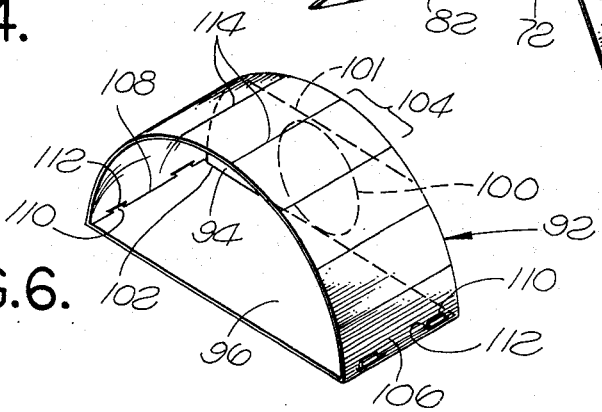
FIG. 6 is a front perspective view of a third embodiment with edges continued by dashed lines.

Referring to FIG. 6, a third embodiment is illustrated wherein an enclosure 92 is provided defined by a rear wall 94, a bottom wall 96 and a roof 98. The rear wall is formed in the shape of a semi-circle and, as in the previous embodiments, is sufficiently wide and high to provide a central extent, shown by the dashed lines 100, approximating the perimeter dimension of a human head. The rear wall tapers curvilinearly from its bottom edge beyond a region 101 above the central extent 100.

The bottom wall 96 is hingedly connected to the rear wall by a score line 102, which as in the previous embodiments, comprises a set of parallel score lines for flexure of corrugated board. The roof 98 is hingedly connected via a score line along a narrow central portion 104 to a corresponding edge portion of a rear wall 94. Opposite side edges 106 and 108 of the roof 98 are connected to the bottom wall 96 by means of tabs 110, extending from the bottom wall 96, which lock with slots 112 formed through the roof material at its side edges 106 and 108. The roof is provided with a plurality of spaced score lines 114, parallel to the side edges 106 and 108, to facilitate bending of the roof into a semi-circular form. The result is a structure semi-circular in vertical cross-section and, while not nestable, the enclosure 92 does provide a bottom wall on which the head can rest.

Various modifications can be made in the foregoing structures, for example, bottom walls can be provided for the structures of FIGS. 1–3 and 5. Other connecting score lines and tab-slot combinations can be provided. For example, in the embodiment of FIG. 5, both side walls 76 and 78 can be hingedly connected via score lines to the rear wall 72 and joined at their top edges by locking tab and slot combinations. Other means can be used to secure the abutting edges other than tab and slot combinations, such as adhesive, tape, Velcro sheets (a trademark for filamentary hook and loop connectors), snaps, eyelets and strings, etc. Furthermore, the units can be elongated so as to accommodate more than one person.

I claim:

1. A device for retaining face warmth, formed of an integral, one-piece, generally planar blank of rigid material having a metallized surface on at least one planar side, said blank being cut and scored to provide a plurality of walls for folding towards said metallized surface, the edge portions of non-adjacent walls in said blank, which abut when said structure is fully folded, being formed in combination with interlocking tabs and slots, said walls comprising a rear wall hingedly connected along a score line to at least one of said other walls, said other walls being foldable respective each other at said rear wall to form a self-supporting enclosure for a human head, said rear wall having a horizontally central extent approximating the perimeter dimension of a human head, said rear wall having a bottom edge of about 15-26 inches, the width dimension of said rear wall tapering from its bottom edge to at least a region above said central extent, the dimension of said rear wall at said region being about 10-13 inches.

2. The device of claim 1 wherein said metallized surface is aluminized.

3. The device of claim 1 wherein said rigid material is formed of corrugated board.

4. The device of claim 1 open at front and bottom whereby a plurality thereof can be nested.

5. The device of claim 1 wherein said taper is rectilinear.

6. The device of claim 1 wherein said other walls comprise a top wall and two side walls, said hinged connection being between the top edge of said rear wall and rear edge of said top wall, said side walls being hingedly connected to said top wall on opposite edges thereof along score lines normal to the line of said first-mentioned hinged connection.

7. The device of claim 6 wherein said rear wall is scored from its bottom edge to said first-mentioned hinge on opposite sides of said central extent whereby to provide flexure of said rear wall during assembly of said structure.

8. The device of claim 5 wherein said other walls comprise a pair of side walls, said hinged connection being between the rear edge of at least one of said side walls and a side, linearly tapered edge of said rear wall.

9. The device of claim 5 wherein said other walls comprise first and second side walls, said hinged connection being between the rear edge of said first side wall and a linearly tapered side edge of said rear wall, and including means for connecting said side walls along their top edges and means for connecting the abutting edge portions of said second and rear walls, to form a gabled structure.

10. The device of claim 1 wherein said taper is curvilinear, and wherein said other walls comprise a bottom wall and a curvible roof wall, said hinged connection being between the bottom edge of said rear wall and the rear edge of said bottom wall, and including means for connecting a central portion of said roof wall to said rear wall and means for connecting opposite side edges of said roof wall to respective opposite side edges of said bottom wall.

* * * * *